US009947489B2

(12) United States Patent
Kralik

(10) Patent No.: US 9,947,489 B2
(45) Date of Patent: Apr. 17, 2018

(54) ELECTRIC SWITCHING APPARATUS COMPRISING AN IMPROVED ARC-QUENCHING DEVICE

(71) Applicant: SCHALTBAU GMBH, Munich (DE)

(72) Inventor: Robert Kralik, Poing (DE)

(73) Assignee: Schaltbau GmbH, Munich (DE)

( * ) Notice: Subject to any disclaimer, the term of this patent is extended or adjusted under 35 U.S.C. 154(b) by 0 days.

(21) Appl. No.: 15/129,614

(22) PCT Filed: Mar. 25, 2015

(86) PCT No.: PCT/EP2015/000639
§ 371 (c)(1),
(2) Date: Sep. 27, 2016

(87) PCT Pub. No.: WO2015/144309
PCT Pub. Date: Oct. 1, 2015

(65) Prior Publication Data

US 2017/0178831 A1 Jun. 22, 2017

(30) Foreign Application Priority Data

Mar. 27, 2014 (DE) ..... 10 2014 004 455

(51) Int. Cl.
*H01H 9/36* (2006.01)
*H01H 9/44* (2006.01)
(Continued)

(52) U.S. Cl.
CPC ..... *H01H 9/443* (2013.01); *H01H 9/34* (2013.01); *H01H 9/36* (2013.01); *H01H 33/596* (2013.01); *H01H 73/18* (2013.01)

(58) Field of Classification Search
CPC ..... H01H 9/443; H01H 2050/025; H01H 50/546; H01H 50/02; H01H 50/54;
(Continued)

(56) References Cited

U.S. PATENT DOCUMENTS 8,853,586 B2 * 10/2014 Theisen ..... H01H 1/2066 218/26
2009/0102585 A1 * 4/2009 Annis ..... H01H 9/446 335/132

(Continued)

FOREIGN PATENT DOCUMENTS

DE 28 51 522 A1 5/1980
DE 28 51 560 A1 5/1980
GB 1 082 175 A 9/1967

OTHER PUBLICATIONS

International Search Report dated Jun. 17, 2015, issued in PCT/EP2015/000639, filed Mar. 25, 2015, to Schaltbau GMBH. 2 pages.

*Primary Examiner* — Truc Nguyen
(74) *Attorney, Agent, or Firm* — Kilpatrick Townsend & Stockton LLP

(57) ABSTRACT

The present invention relates to an electric switching apparatus, in particular a DC contactor. The switching apparatus has at least one switching point as well as at least one arc-quenching device that is assigned to the switching point. The arc-quenching device comprises at least one quenching element and at least one permanent magnet for influencing an arc that arises during the switching process. The arc is blown into the quenching element by a magnetic field that is created by the permanent magnet. It is provided according to the invention that the at least one permanent magnet forms at the same time the quenching element and that it is arranged and polarized in a way that the arc is attracted by the permanent magnet and thereby sucked onto the permanent magnet and quenched by said permanent magnet.

14 Claims, 6 Drawing Sheets

Figure 1:
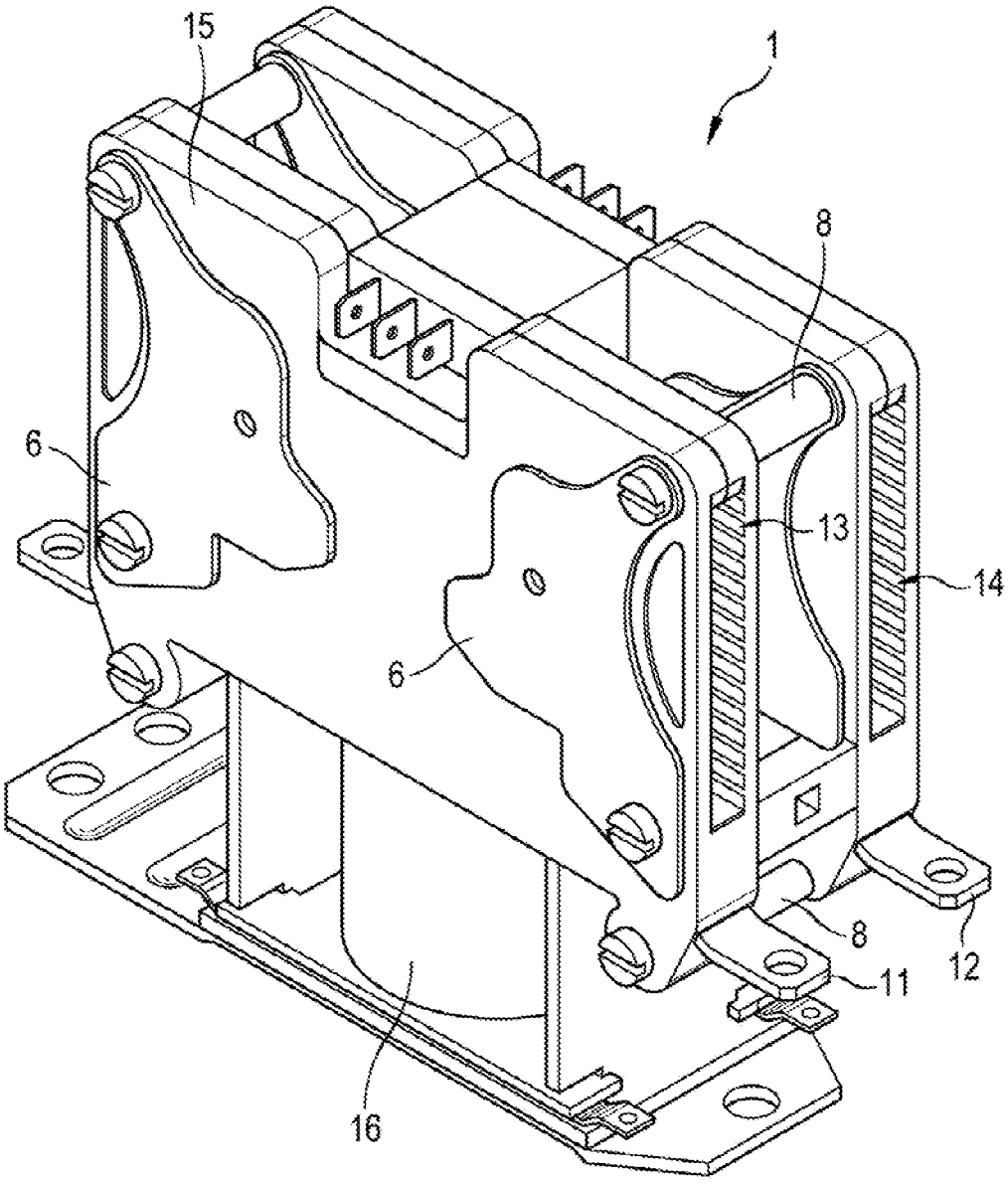

(51) Int. Cl.
*H01H 9/34* (2006.01)
*H01H 33/59* (2006.01)
*H01H 73/18* (2006.01)

(58) Field of Classification Search
CPC ..... H01H 51/06; H01H 1/66; H01H 50/443; H01H 1/36; H01H 50/00; H01H 50/045; H01H 50/30; H01H 50/40; H01H 50/60; H01H 51/00
See application file for complete search history.

(56) References Cited

U.S. PATENT DOCUMENTS

| | | | | |
|---|---|---|---|---|
| 2009/0120908 | A1* | 5/2009 | Domejean | H01H 9/346 218/23 |
| 2013/0057369 | A1* | 3/2013 | Yano | H01H 1/66 335/156 |
| 2014/0151338 | A1* | 6/2014 | Gerving | H01H 1/20 218/26 |

* cited by examiner

ELECTRIC SWITCHING APPARATUS COMPRISING AN IMPROVED ARC-QUENCHING DEVICE

This application is a US National Phase of PCT/EP2015/000639, filed Mar. 25, 2015, which claims priority to German Application No. 10 2014 004 455, filed Mar. 27, 2014, the entirety of which are incorporated by reference herein.

The present invention relates to an electric switching apparatus according to the preamble of the independent Claim 1. An electric switching apparatus of the generic kind has at least one switching point as well as at least one arc-quenching device assigned to said switching point, whereby the arc-quenching device comprises at least one quenching element and at least one permanent magnet for influencing an arc occurring during the switching process. The arc is blown by a magnetic field produced by the permanent magnet into the quenching element. The electric switching apparatus is in particular a unidirectionally switching DC contactor.

At the switching point of the switching contactor, a switching arc is formed during the switching process, i.e. during opening of the contact points. In this process, a significant amount of thermal energy is released, which can lead to damage of the switching apparatus. In particular, the existence and/or effect of the switching arc can lead to damage or destruction of the switching apparatus when particularly high currents are being switched.

Therefore, it is known from the state of the art to provide a so-called arc-quenching device that ensures that the switching arc will go off as fast as possible. Usually, several quenching elements are provided for this purpose in direct proximity of the switching point. The quenching elements are usually formed in a plate-shaped way and arranged at a distance from one another. They divide and cool the switching arc and therefore make it go off. Both quenching sheets as well as ceramic quenching plates can be used as quenching elements. A suitable magnetic field is created to drive (blow) the switching arc into the quenching elements. A permanent magnet is usually provided to create the magnetic field. In addition, the design of the magnetic field can be influenced appropriately by means of pole plates.

An electric switching apparatus of the generic kind is known for example from the German patent specification DE 1246851 B. The arc-quenching device of the electric switching apparatus described therein has a plurality of deionized sheets as quenching sheets. The switching arc is blown into the quenching sheets by a permanent magnet.

A further electric switching apparatus of the generic kind is further known from the DE 102010031907 B9. Also here, a permanent magnet is used as a blowing magnet. The quenching elements are designed as ceramic quenching plates in this switching apparatus.

Switching apparatuses of the type mentioned at the beginning are for example used as DC contactors in solar technology. The requirements that have to be met by the switching apparatus in this area are becoming increasingly stringent. At the same time, there is a continuously increasing cost pressure. Due to the cost pressure, switching contactors with relatively small dimensions are used whose switching capacity, however, is often no longer in line with the growing requirements. In particular, the switching capacity of the switching contactors used is not sufficient to switch potentially arising short circuit currents. This means that the switching arc that is formed in the switching process cannot be quenched safely.

The present invention therefore has the purpose of providing an electric switching apparatus of the generic kind with an improved arc-quenching device. The improvement of the arc-quenching device and hence the improvement of the switching capacity of the electric switching apparatus should thereby be as cost-efficient and easy to implement as possible. In particular, the invention should be suitable for DC contactors with relatively small dimensions to be used in solar technology. The switching capacity should be improved without a significant increase of the dimensions of the electric switching apparatus.

The problem is solved by the features of the independent Claim 1. According to said claim, there will be a solution of the problem according to the invention with regard to the electric switching apparatus of the generic type if the at least one permanent magnet forms the quenching element at the same time and is arranged and polarized in a way that the arc is attracted by the permanent magnet and therefore sucked onto the permanent magnet and quenched by said permanent magnet. Surprisingly, it has become clear the a permanent magnet can be used as a quenching element instead of a quenching sheet or a ceramic quenching plate, i.e. for cooling and hence for quenching of the switching arc. The solution according to the invention has the advantage that the switching arc does not have to be blown into the quenching area by an additional external blowing field. Rather, the switching arc is attracted by the quenching element and/or the quenching elements (quenching area) itself/themselves. It has become clear that the switching arc can be quenched particularly fast and reliably due to this. The solution according to the invention can be implemented cost-efficiently and easily. In addition, it has the advantage that the switching capacity of existing switching contactors can be improved significantly with conventional arc-quenching devices while the external dimensions remain constant to a large extent. Apart from this, the invention does not exclude the possibility that a conventional blowing magnet, whose magnetic field reinforces the blowing effect and is aligned appropriately by means of pole plates that are potentially provided in addition, is provided in addition to the permanent magnet that is designed as a quenching element.

Advantageous embodiments of the present invention are the object of the sub-claims.

In a particularly preferred embodiment of the present invention, the arc-quenching device has a quenching chamber, whereby the quenching chamber has an outlet opening and whereby the at least one permanent magnet, which is used as a quenching element, is arranged in the area of the outlet opening. The gases created by the arc and/or the plasma created by the arc are led out of the switching apparatus to the outside through the outlet opening. In this embodiment, a particularly reliable quenching of the arc is ensured. Particularly preferably, the permanent magnet that serves as a quenching element is arranged outside of the quenching chamber in the area of the outlet opening in this process.

In a further preferred embodiment of the present invention, further quenching elements in form of quenching sheets or ceramic quenching elements are provided in addition to the permanent magnet that is used as a quenching element. The further quenching elements are arranged between the permanent magnet and the switching point within the quenching chamber. Reliability of the arc quenching is further improved in this embodiment. Further, the lifespan of the permanent magnet that is used as a quenching element is increased by this arrangement.

In a further particularly preferred embodiment of the present invention, the permanent magnet is enclosed by a protection sleeve made of ceramic at least in the area that is exposed to the arc. The permanent magnet is preferably enclosed in its entire length by the protection sleeve. In this embodiment, the arc-quenching effect of the permanent magnet is conserved almost completely even after many switching cycles. The lifespan is consequently increased. Preferably magnesium aluminum silicate or, particularly preferably, calcium aluminate is used as a ceramic material for the protection sleeve. Further preferably, the ceramic material is glass fiber-reinforced so that the protection sleeve is particularly robust and protected against mechanical damage. Particularly preferably, glass fiber-reinforced calcium aluminate with silicone resin is used in this context.

In a particularly preferred embodiment of the present invention, the arc-quenching device has at least two permanent magnets that are each used as a quenching element and that are arranged and polarized in a way that the arc is attracted by the at least two permanent magnets that form quenching elements at the same time. Particularly preferably, even multiple permanent magnets are provided per arc-quenching device. This reinforces the arc-quenching effect and increased the switch-off capacity. The permanent magnets that are used as quenching elements are all polarized in the same direction for this purpose. It will be advantageous if all permanent magnets are each enclosed by a ceramic protection sleeve at least in the area that is exposed to the arc.

Preferably, the permanent magnet(s) is/are particularly strong so that the magnetic flux density that impacts from the permanent magnet(s) onto the arc amounts to at least 20 millitesla, preferably at least 25 millitesla. This ensures that the arc will be sucked and quenched by the permanent magnet(s) without further support.

In this context, it will be particularly advantageous if the permanent magnets are spaced in relation to one another in the same way as conventional quenching sheets or ceramic quenching elements. Particularly fast and effective quenching of the arc can be achieved in this way. The distance between the permanent magnets is preferably larger than one millimeter and is further preferably in the range between 1 and 3 mm. The spaced arrangement of the permanent magnets also has the advantage that the plasma, which is created by the switching arc, can be led to the outside through the gap between the permanent magnets. Further preferably, the permanent magnets are formed with a longish shape and aligned in a way that their magnetic axes are perpendicular to the projected longitudinal alignment of the switching arcs.

In a further particularly preferred embodiment of the present invention, the permanent magnets consist of hard ferrite. Hard ferrite is a ceramic material, whereby the permanent magnets—similar to conventional quenching elements made of ceramic—are particularly suitable for arc quenching. Also, particularly effective cooling of the switching arcs can be achieved if hard ferrite permanent magnets are used.

In a further preferred embodiment of the present invention, the permanent magnets are designed as rod magnets. Thereby, a particularly good quenching effect is achieved on one hand while rod magnets are standard components that can be obtained at particularly economic conditions on the other hand. A particularly effective quenching effect can be achieved if the permanent magnets have a cylindrical design, i.e. as round magnets. The axes of the permanent magnets are preferably in a common plane and are further preferably aligned in parallel to one another.

In a further particularly preferred embodiment of the present invention, the permanent magnets are installed on the electric switching apparatus by means of a joint support. Assembly will therefore be particularly easy. In addition, the joint support can ensure that an optimal distance between the individual permanent magnets will always be maintained. It is particularly advantageous if the support can be clipped onto the switching apparatus. Assembly is thereby facilitated further. In addition, this comes with the advantage that existing electric switching apparatuses, for example existing DC contactors, can be retro-fitted in a particularly easy way according to the invention. For this purpose, the support is preferably designed in a way that it can be clipped onto the housing or existing components of the electric switching apparatus. Particularly suitable for installation are for example uncovered or cylindrically enclosed connection bolts of the switch housing.

In a further particularly preferred embodiment of the present invention, the arc-quenching device is assigned to the quenching areas of at least two poles of the switching apparatus that are arranged next to one another, whereby the permanent magnet or the permanent magnets of the arc-quenching device extends/extend over the combined width of the switching points that are arranged next to one another. This embodiment is particularly suitable for example for bipolar DC contactors. In such contactors, two switching points are usually arranged next to one another so that also two switching arcs can arise next to one another. This embodiment is particularly cost-efficient and easy to manufacture as only one arc-quenching device is required for the quenching areas of two or even multiple poles that are located next to one another.

A particularly advantageous and especially space-saving arrangement will emerge in this context if the support of the permanent magnets is arranged at least partially between the switching points or poles that are arranged next to one another.

The invention further provides an arc-quenching device for an electric switching apparatus. The arc-quenching device comprises at least one quenching element and at least one permanent magnet for influencing an arc that arises in the switching process, whereby the arc is blown into the quenching element by a magnetic field that is created by the permanent magnet. According to the invention, the at least one permanent magnet forms at the same time the quenching element and is arranged and polarized in a way that the arc is attracted by the permanent magnet and thereby sucked automatically onto the permanent magnet and quenched by said permanent magnet.

The present invention further provides a method to increase the switching capacity of an electric switching apparatus with at least one switching point as well as at least one arc-quenching device that is assigned to the switching point, whereby the arc-quenching device has a plurality of quenching sheets or ceramic quenching elements for arc quenching.

In the method according to the invention, one or multiple permanent magnets are installed in the area of the outlet opening of a quenching chamber of the arc-quenching device on the electric switching apparatus so that the permanent magnet and/or the permanent magnets forms/form a quenching element and is/are arranged and polarized in such a way that the arc is attracted by the permanent magnet and thereby sucked onto the permanent magnet and quenched by said permanent magnet. The quenching sheets or ceramic quenching elements can optionally be removed or remain in the apparatus for additional support of the arc-quenching process.

Alternatively, the method according to the invention comprises the following method steps:

removal of the quenching sheets or ceramic quenching elements, and installation of one or multiple permanent magnets on the electric switching apparatus as a substitute for the quenching sheets or ceramic quenching elements so that the permanent magnet and/or the permanent magnets forms/form the quenching element and that it/they is/are arranged and polarized in a way that the arc is attracted by the permanent magnet and thereby sucked magnetically onto the permanent magnet and quenched by said permanent magnet.

With the method according to the invention, existing electric switching apparatuses, in particular DC contactors, can be retrofitted in an easy way in order to increase their switching capacity and in particular their short circuit switchability. The permanent magnets are preferably arranged directly in front of the openings of the quenching chambers of which the conventional quenching sheets or ceramic quenching elements have been removed.

Figure 2:
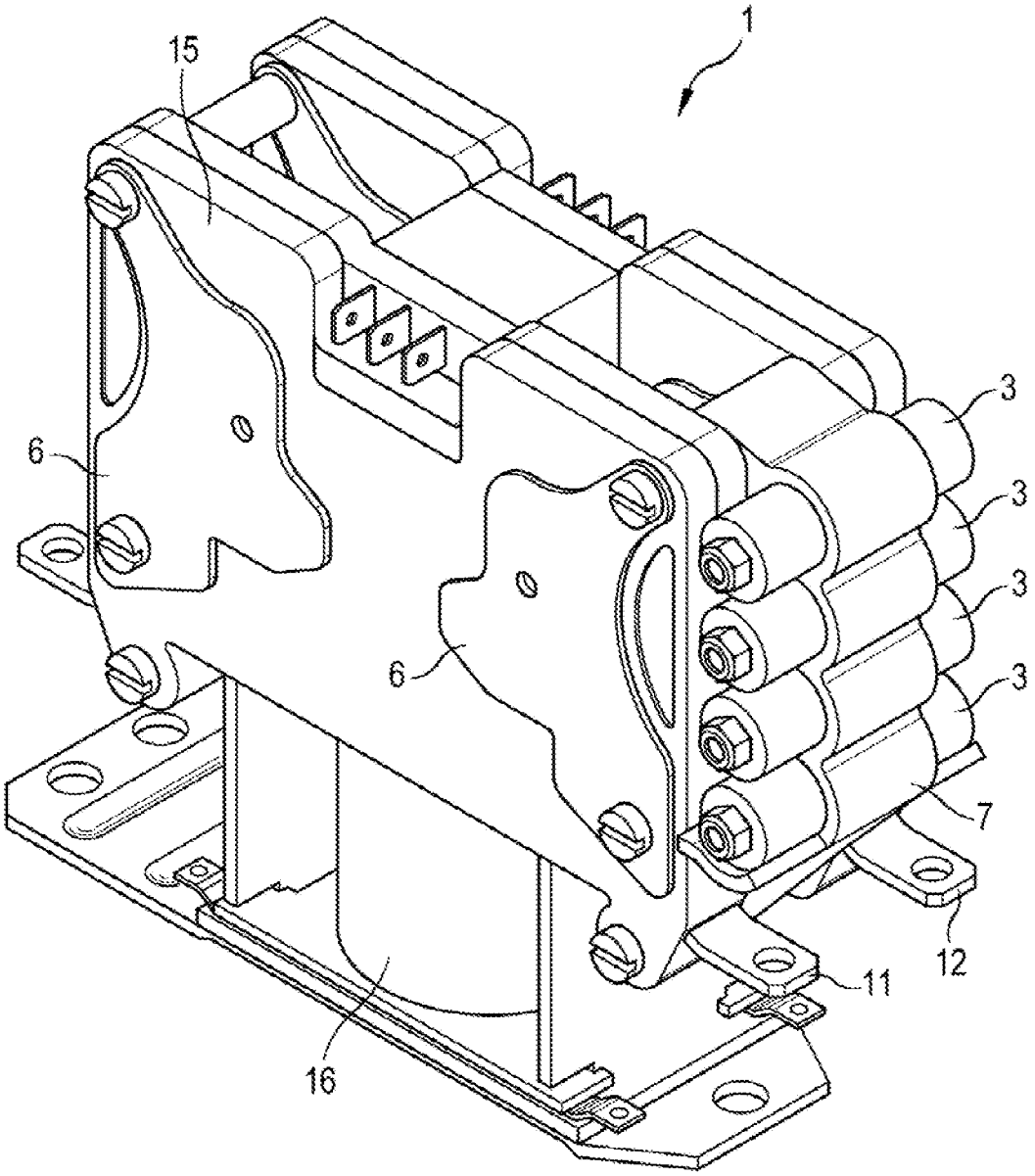
Figure 3:
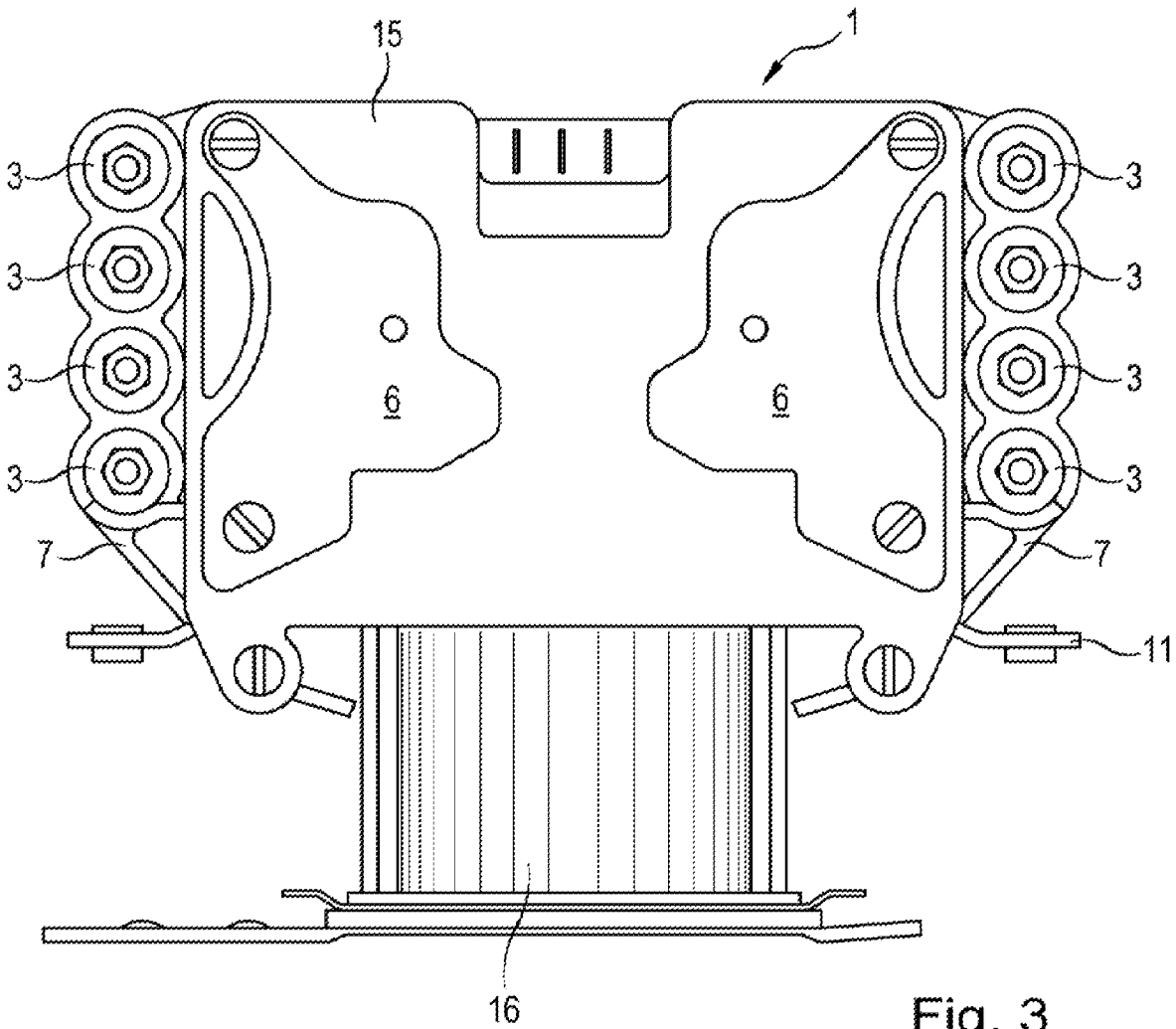
Figure 4:
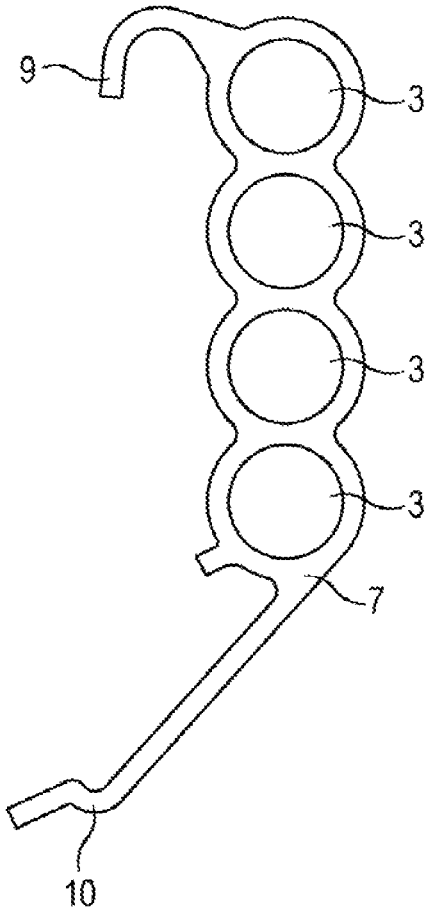
Figure 5:
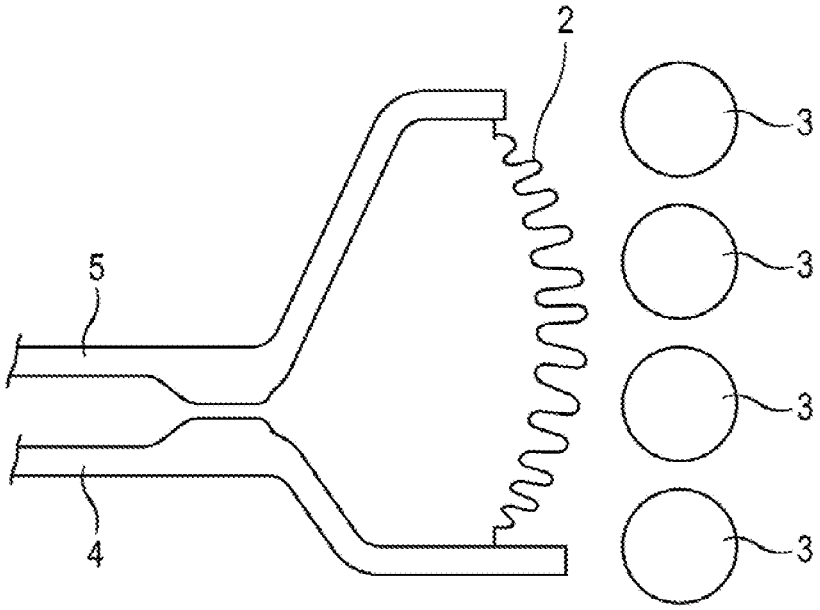
Figure 6:
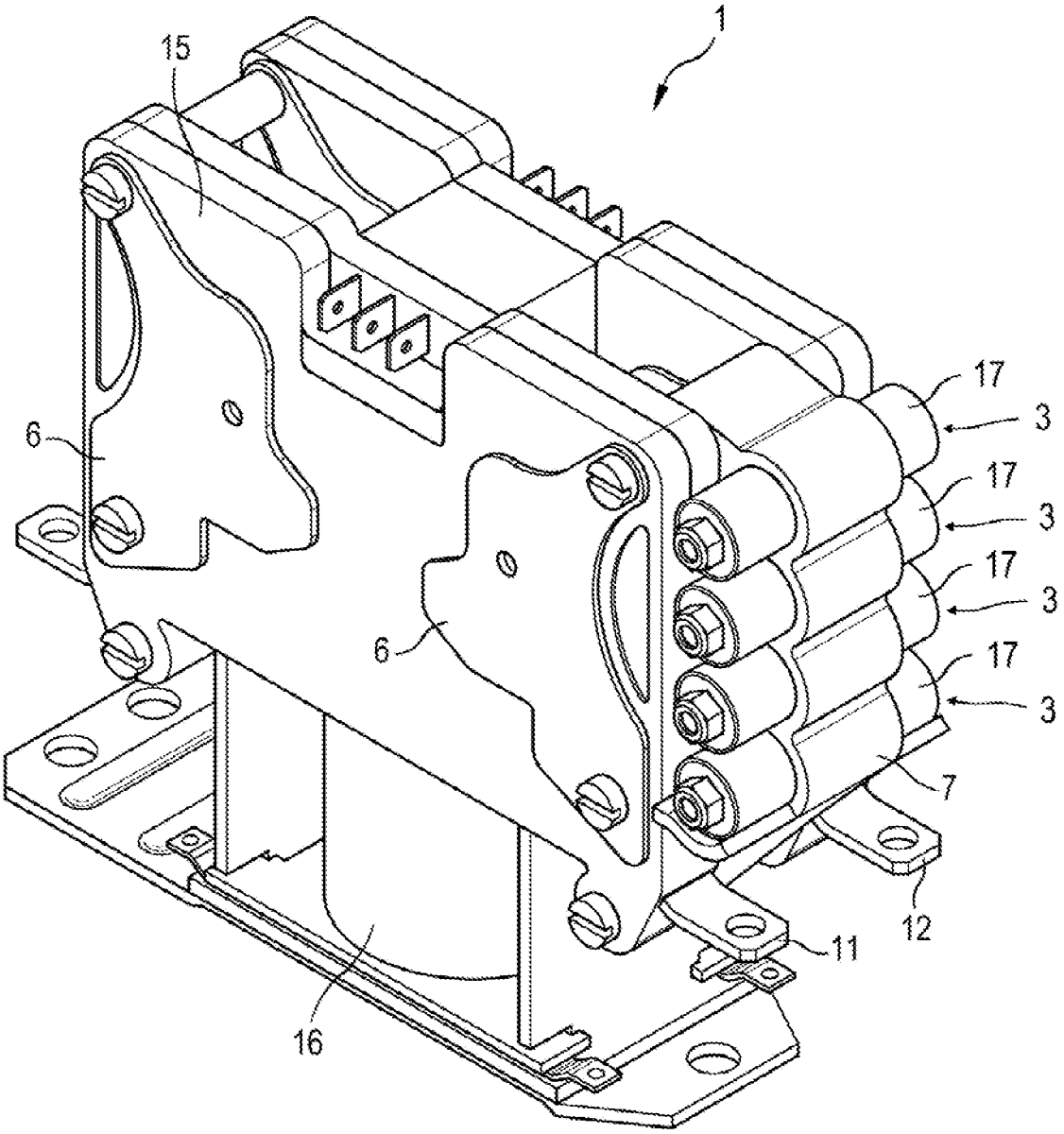

An embodiment of the present invention will be explained in greater detail by means of drawings in the following. The drawings show:

FIG. 1 an oblique view of a bipolar DC contactor,

FIG. 2 the DC contactor from FIG. 1 in a design according to the invention with permanent magnets installed on it, FIG. 3 a front view of the switching contactor from FIG. 2 according to the invention, FIG. 4 a detail display of the permanent magnet besides corresponding support that is installed on the switching contactor shown in the FIG. 1-3, FIG. 5 a schematic display of a switching point of the switching contactor according to the invention from the FIGS. 1-3 with a permanent magnet that is arranged according to the invention, and FIG. 6 the display from FIG. 2 with ceramic protection sleeves for the permanent magnets.

Identical parts are designated with identical reference signs in the following explanations. If reference signs, which are not described in greater detail in the pertaining description of Figures, are included in a drawing, reference will be made to preceding or subsequent descriptions of Figures.

FIG. 1 shows a unidirectionally switching, bipolar DC contactor 1 of a conventional type that has already been prepared for an implementation according to the invention. The contactor has a housing 15 in which the switching mechanism and the movable contacts are included. Below the actual switching mechanism 15, the electromagnetic drive 16 of the contactor is shown. Two connection contacts 11 and 12 can be seen on the narrow front side of the housing. As the contactor is a bipolar switching contactor, a total of four connection contacts are provided. Each of the two connection contacts 11 and 12 that are provided on the narrow front side of the housing can therefore be connected to a corresponding connection contact on the opposite narrow housing side by means of the switching contactor. Each of the four connection contacts leads to a fixed contact on the inside of the housing. In addition, two switching bridges, which are actuated by the electromagnetic drive 16 and which connect and/or separate respectively two of the fixed contacts to/from one another, are arranged inside the housing. Hence, there are four switching points in total, i.e. respectively between one of the fixed contacts and the respective associated contact bridge. Each switching point is assigned an arc-quenching chamber. Two of the total of four quenching chambers can be seen on the narrow front side of the housing, i.e. the left quenching chamber 13 and the right quenching chamber 14. Both of the shown quenching chambers 13 and 14 have each an opening to the outside so that the plasma created by the switching arc can flow from the inside of the housing to the outside. The inserting slits for conventional quenching sheets, which have already been removed in the shown switching contactor, are displayed clearly in FIG. 1. Also, the magnetic pole plates 6 of the blowing magnets, which are arranged on the inside of the housing and through which the switching arc is blown into the quenching sheets in the conventional embodiment of the switching contactor, are shown.

Instead of the conventional quenching sheets, an arc-quenching device according to the invention, which is installed on the housing 15 of the switching contactor, is used for the shown switching contactor. The switching contactor from FIG. 1 is shown in FIG. 2 with an arc-quenching device according to the invention. It consists essentially of four cylindrical permanent magnets 3 that are arranged directly in front of the openings of the two quenching chambers 13 and 14. As shown in particular in FIG. 4, the four permanent magnets 3 are held by a joint support 7 that can be installed on the housing 15 of the switching contactor 1. The support ensures that the four longishly formed cylindrical permanent magnets are first held in parallel to one another and second at a slight distance from one another. The axes of the four permanent magnets are situated in a plane that is aligned in parallel to the directly adjacent narrow side of the housing. The parallel alignment can be seen best in FIG. 3. In addition, FIG. 3 shows that also the two contact points, which are located on the opposite narrow side of the housing, are equipped with an arc-quenching device according to the invention. The distance between the external circumference of two neighboring permanent magnets is approx. 2 mm. The permanent magnets 3 can be glued or screwed for example to the support 7.

Fixing of the arc-quenching device according to the invention on the housing 15 of the switching contactor is done by means of a clipping connection. FIG. 4 shows that the support 7 of the permanent magnets 3 has two elastic clip ends 9 and 10 for this purpose. They are formed in a way that they snap into place with the two cylindrical housing elements 8 shown in FIG. 1 during installation of the support on the housing. The upper clip end 9 is therefore at first suspended on the upper one of the two cylindrical housing elements 8 and then the lower clip end 10 is pressed against the lower cylindrical housing element so that it springs back slightly and subsequently snaps into place with this lower cylindrical housing element. The two cylindrical housing elements 8 are spacers, which are arranged between the two quenching chambers 13 and 14, and that enclose corresponding fixing bolts, which are used to keep the housing together, in the area between the two quenching chambers. Due to the support 7 of the permanent magnets 3 being installed on the two spacers 8 that are arranged between the quenching chambers 13 and 14, also the support itself is located between the openings of the two quenching chambers. The permanent magnets 3, in turn, protrude laterally from the support and therefore extend respectively on one side over the entire width of the opening of the left quenching chamber 13, and on the other side over the entire width of the opening of the right quenching chamber 14. This way, only one arc-quenching device according to the invention will be required for two switching points.

FIG. 5 shows a schematic display to explain the functionality of the arc-quenching device according to the invention. Displayed are a switching point, consisting of one of the fixed contacts 4 that is arranged on the inside of the housing, and the end of the respective contact bridge 5 that is assigned to this fixed contact. The end of the contact bridge consequently forms the movable counter-contact that is actuated by the drive 16 of the switching contactor according to the invention. The display shows a snapshot shortly after opening of the two contacts 4 and 5. During the opening process, a switching arc 2, which is blown and/or driven through the magnetic field of the blowing magnet that is not shown and in addition also through the magnetic field of the permanent magnets 3 according to the invention to the right into the permanent magnets 3, emerges between the contact points. FIG. 5 shows that the axes of the permanent magnets 3 are essentially aligned perpendicularly to the projected longitudinal extension of the switching arc 2. Therefore, also the magnetic field that is established by the permanent magnets 3 is aligned perpendicularly to the longitudinal extension of the switching arc. The magnetic field ensures that the switching arc 2 will migrate to the right and finally hit the permanent magnet 3. There, it is elongated and quenched subsequently. The permanent magnets consist, according to the invention, of hard ferrite. Hard ferrite is a ceramic material, whereby the permanent magnets 3 are excellently suited for cooling and quenching of arcs, similar to conventional quenching elements made of ceramic. The plasma created by the switching arc 2 is transported to the outside through the slits between the permanent magnets 3.

FIG. 6 shows a particularly preferred embodiment of the invention. The display is equivalent to the display from FIG. 2, with the difference that the permanent magnets 3 are each enclosed by a protection sleeve 17 made of ceramic. The protection sleeves have a hollow cylindrical form and fit close to the external circumference of the respective permanent magnet. They can for example be glued to the permanent magnet.

It should be noted that the invention is not only suitable for retrofitting of existing switching contactors, but that it can also and especially be used in completely newly developed electric switching apparatuses. The invention comes with the advantage that the switching capacity of electric switching apparatuses can be improved in a particularly simple way and without significantly more required space. Blowing arrangements with a conventional design, which drive the switching arc into the quenching arrangements, can be provided in addition but are not always absolutely necessary as the switching arc in the arc-quenching device according to the invention is attracted by the permanent magnets of the arc-quenching device themselves. The permanent magnets are blowing magnets and quenching elements at the same time.

The invention claimed is:

1. An electric switching apparatus in the form of a DC contactor comprising:

at least one switching point; and at least one arc-quenching device that is assigned to the switching point, wherein the arc-quenching device comprises at least one permanent magnet, wherein at least one of the at least one permanent magnets forms a quenching element, wherein the arc-quenching device is configured for influencing of an arc that arises during a switching process, whereby the arc is blown into the quenching element by a magnetic field created by the at least one permanent magnet, wherein the quenching element is arranged and polarized in a way that the arc is attracted by the magnetic field causing the arc to be sucked onto the permanent magnet of the quenching element and quenched by said permanent magnet, and wherein the permanent magnet of the quenching element is enclosed, at least in the area that is exposed to the arc, by a protection sleeve made of ceramic.

2. The electric switching apparatus according to claim 1, characterized in that the arc-quenching device has a quenching chamber, whereby the quenching chamber has an outlet opening, and whereby the at least one permanent magnet that is used as a quenching element is arranged in the area of the outlet opening.

3. The electric switching apparatus according to claim 1, characterized in that the arc-quenching device has at least two permanent magnets that are each used as a quenching element and that are polarized in the same direction and arranged in a way that the arc is attracted by the at least two permanent magnets that form quenching elements at the same time.

4. The electric switching apparatus according to claim 1, characterized in that the permanent magnet is configured so that the magnetic flux density that impacts from the permanent magnet onto the arc is at least 20 millitesla, preferably at least 25 millitesla.

5. The electric switching apparatus according to claim 3, characterized in that the permanent magnets are arranged at a distance from one another between 1 mm and 3 mm.

6. The electric switching apparatus according to claim 1, characterized in that the permanent magnets consist of hard ferrite.

7. The electric switching apparatus according to claim 1, characterized in that the permanent magnets are designed as cylindrical rod magnets.

8. An electric switching apparatus in the form of a DC contactor comprising:

at least one switching point; and at least one arc-quenching device that is assigned to the switching point, wherein the arc-quenching device comprises at least one permanent magnet, wherein at least one of the at least one permanent magnets forms a quenching element, wherein the arc-quenching device is configured for influencing of an arc that arises during a switching process, whereby the arc is blown into the quenching element by a magnetic field created by the at least one permanent magnet, wherein the quenching element is arranged and polarized in a way that the arc is attracted by the magnetic field causing the arc to be sucked onto the permanent magnet of the quenching element and quenched by said permanent magnet, wherein the permanent magnet of the quenching element is enclosed, at least in the area that is exposed to the arc, by a protection sleeve made of ceramic, and wherein the permanent magnets are installed on the electric switching apparatus by means of a joint support.

9. The electric switching apparatus according to claim 8, characterized in that the support can be clipped onto the switching device.

10. An electric switching apparatus in the form of a DC contactor comprising:

at least one switching point; and at least one arc-quenching device that is assigned to the switching point, wherein the arc-quenching device comprises at least one permanent magnet, wherein at least one of the at least one permanent magnets forms a quenching element, wherein the arc-quenching device is configured for influencing of an arc that arises during a switching process, whereby the arc is blown into the quenching element by a magnetic field created by the at least one permanent magnet, wherein the quenching element is arranged and polarized in a way that the arc is attracted by the magnetic field causing the arc to be sucked onto the permanent magnet of the quenching element and quenched by said permanent magnet, wherein the permanent magnet of the quenching element is enclosed, at least in the area that is exposed to the arc, by a protection sleeve made of ceramic, and wherein the arc-quenching device is assigned to at least two switching points of the switching apparatus that are arranged next to one another, whereby the permanent magnet or the permanent magnets of the arc-quenching device extends/extend over a combined width of the switching points that are arranged next to one another.

11. The electric switching apparatus according to claim 10, characterized in that the support is disposed between the switching points that are arranged next to one another.

12. An arc-quenching device for an electric switching apparatus with at least one switching point, whereby the arc-quenching device comprises at least one permanent magnet, wherein at least one of the at least one permanent magnets forms a quenching element, wherein the arc-quenching device is configured for influencing an arc that emerges during a switching process, whereby the arc is blown into the quenching element by a magnetic field that is created by the at least one permanent magnet, wherein the quenching element is arranged and polarized in a way that the arc is attracted by the magnetic field causing the arc to be sucked onto the permanent magnet of the quenching element and quenched by said permanent magnet, and wherein the permanent magnet is enclosed, at least in the area that is exposed to the arc, by a protection sleeve made of ceramic.

13. A method for increasing the switching capacity of an electric switching apparatus with at least one switching point as well as at least one arc-quenching device that is assigned to the switching point, whereby the arc-quenching device has a quenching chamber with an outlet opening as well as a plurality of quenching sheets or ceramic quenching elements for arc quenching, whereby one or multiple permanent magnet(s) are installed on the electric switching apparatus in the area of the outlet opening so that the permanent magnet and/or the permanent magnets forms/form a quenching element and is/are arranged and polarized in a way that the arc is attracted by the permanent magnet and thereby sucked onto the permanent magnet and quenched by said permanent magnet, characterized in that the permanent magnet is enclosed, at least in the area that is exposed to the arc, by a protection sleeve made of ceramic.

14. The method according to claim 13, characterized in that the quenching sheets or ceramic quenching elements are at first removed, and that the permanent magnet(s) is/are installed on the electric switching apparatus as a substitute for the quenching sheets or ceramic quenching elements.

* * * * *